United States Patent [19]

Beyer et al.

[11] 3,952,698

[45] Apr. 27, 1976

[54] CAN TREATING SYSTEM

[75] Inventors: Arnold D. Beyer, Newark; Charles R. Crockett; Patrick G. Mitchell, both of Oakland, all of Calif.

[73] Assignee: Kaiser Aluminum & Chemical Corporation, Oakland, Calif.

[22] Filed: June 19, 1974

[21] Appl. No.: 480,807

Related U.S. Application Data

[63] Continuation-in-part of Ser. No. 401,401, Sept. 27, 1973.

[52] U.S. Cl. ..... 118/314; 118/73; 118/317; 134/68

[51] Int. Cl.[2] ..... B05C 7/02

[58] Field of Search ..... 118/313, 314, 316, 317, 118/73, 75; 134/68, 72; 113/120 A

[56] References Cited

UNITED STATES PATENTS

| | | | |
|---|---|---|---|
| 692,079 | 1/1902 | Snortley et al. | 118/73 |
| 1,583,034 | 5/1926 | Valerius et al. | 134/68 |
| 1,936,279 | 11/1933 | Webb | 134/68 |
| 2,084,093 | 6/1937 | Kronquest | 118/317 |
| 2,250,238 | 7/1941 | Smith | 134/68 |
| 2,275,793 | 3/1942 | Murphy | 118/73 |
| 2,633,437 | 3/1953 | Detjen | 134/72 |
| 2,655,162 | 10/1953 | Zademach et al. | 134/125 |
| 2,716,620 | 8/1955 | Green et al. | 118/75 X |
| 3,268,620 | 8/1966 | Tarwid | 260/834 |
| 3,353,515 | 11/1967 | Stolle et al. | 118/317 |
| 3,403,088 | 9/1968 | Hart | 260/29.4 X |
| 3,497,466 | 2/1970 | Markulin | 117/132 |
| 3,508,997 | 4/1970 | Werling | 118/316 |
| 3,640,758 | 2/1972 | Hogstrom | 118/316 X |
| 3,736,284 | 5/1973 | Fitko | 117/132 A |
| 3,773,589 | 11/1973 | Kaiser et al. | 156/218 |
| 3,776,182 | 12/1973 | Stolle | 118/314 |
| 3,797,456 | 3/1974 | Hogstrom | 118/317 X |

FOREIGN PATENTS OR APPLICATIONS

| | | |
|---|---|---|
| 938,513 | 12/1973 | Canada |

*Primary Examiner*—Mervin Stein
*Attorney, Agent, or Firm*—Paul E. Calrow; John S. Rhoades

[57] ABSTRACT

An improved system for washing and coating metal can bodies, such as seamless aluminum and tin plate can bodies, in a can processing line wherein various can washing, coating and curing stations are arranged in a unique fashion along the line so as to utilize generally fully compatible washing and coating materials, the residues of which are adapted to be either recycled or discharged into a common waste disposal system, as well as an improved coated can body.

25 Claims, 11 Drawing Figures

CAN TREATING SYSTEM

RELATED APPLICATIONS

This application is a continuation-in-part of our prior application Ser. No. 401,401, filed Sept. 27, 1973, and entitled "Can Treating System and Product."

BACKGROUND OF THE INVENTION

The present invention relates to an improved system for coating and corrosion proofing metal cans, such as seamless aluminum as well as tin plate, tin free and blackplate steel cans, which can be drawn and ironed on a draw and iron press located at the initial sections or stations of a typical continuous can production line as well as an improved coated product produced thereby. Prior art can washing devices that have been incorporated in such can manufacturing lines are shown, for example, in U.S. Pat. No. 3,262,460, issued July 26, 1966, and U.S. Pat. No. 3,291,143, issued Dec. 13, 1966. The can washer devices of these patents generally comprise a series of successive wash, rinse and drying stations and intermediate blowoff stations wherein residual oils and greases present on the surfaces of metal containers or cans such as those manufactured on conventional draw and iron presses are first removed from the cans preparatory to the further treatment and handling of the cans. As the cans pass through a washer device of the type shown in U.S. Pat. No. 3,262,460 they are ordinarily subjected to what is generally referred to as a post-cleaning or post-surface treatment by an acid wash, which usually employs an inorganic chromate-phosphate solution in order to make the outside and inside surfaces of the can more receptive to coatings as well as printing inks.

There have been a number of problems coincident with the use of inorganic chromate-phosphate solutions or similar acid washes, in addition to the fact that they are expensive. For example, when such materials are employed in can washes there must be a continual monitoring of the amount of materials used because the overall effectiveness of such acid washes is dependent to a large extent upon the amount of chemical agents in solution. There are also environmental problems involved in disposing of waste chromate-phosphate solutions, in that, in the past it has been a prerequisite during disposal to neutralize the same such as by treating the material with $SO_2$ gas prior to emptying the waste liquors containing such acids or chromate-phosphate solutions into the conventional plant sewers or other waste disposal systems.

On the other hand, despite the disadvantages of the acid wash and complex can handling involved, it has been generally heretofore impossible in a commercial can production line to avoid such a post-cleaning or post-surface can treatment, because the can surfaces had to be sized by such treating processes in order to make them receptive to the coatings and/or printing and decorating inks demanded by can customers. Such acid wash or caustic etching operations were particularly significant in can manufacturing lines, where drawn and ironed metal cans were processed, because the walls of such cans are relatively smooth and slippery and unless appropriately pretreated may not be receptive to coatings and/or printing and decorating inks. For example, the outside wall surfaces of such cans are usually highly polished and buffed due to the action of the ironing dies on such wall surfaces.

A discussion of the can cleaning and coating problems with which this invention is particularly concerned would not be complete without mention being made of the necessity of having appropriate surface coatings applied to the metal cans to avoid attack by the contents. This problem is particularly acute in the case of non-alcoholic and carbonated beverages which today represent a substantial amount of the overall can manufacturing and filling business throughout the world.

The contents of the containers have raised other problems, in that, it has been largely impossible to date to avoid the use of separate and special inside and outside can coatings and curing operations therefor, which can be quite different from each other and require separate, distinct and expensive multi-stage operations. These coatings are required in order for the cans to be utilized as food or beverage containers while complying with various State and Federal laws and/or regulations with respect to different beverages. All of this, in turn, means that the cost of manufacturing and handling the cans is substantially raised each time a separate can coating operation is required.

The instant invention is concerned with minimizing the aforesaid can processing problems and effecting substantial cost reductions by utilizing an improved can body treatment system. A feature of the proposed system is that it involves equipment which is generally compatible with and can be readily integrated with much of the equipment of today's standard metal can processing lines, such as one involving drawn and ironed aluminum or steel cans or impact extruded aluminum metal cans. A particular advantageous and significant feature of the instant container processing system concerns the fact that the coating operation proposed can utilize but a single water based, preferably water soluble and at least water dispersible, organic and preferably polymeric coating having hydrophilic characteristics and excellent wettability properties. For a further discussion of the desirability and need for such a system, reference may be made to an article appearing at pages 23 and 24 of the Mar. 27, 1974, issue of Chemical Week magazine.

The coating in accordance with the invention can be applied to both the inside and outside surfaces of a can simultaneously in a single operation. In one advantageous embodiment of the invention the metal cans are pretreated with a moisture layer that improves and promotes the interfacial surface tension of the metal surfaces and thus enhances the adhesion of the coating material to the metal can. During this coating operation, a common, readily flowable, low viscosity, organic coating material is simultaneously applied in a flooding manner to both inside and outside surfaces of a can such that all of the exterior and interior can surfaces can be said to be simultaneously deluged or innundated with the coating. The manner of coating material application advantageously assists in orienting and positioning the cans relative to the coating applicators during the correlated movement of the cans through the coating zone and no special holders are required as in the case of U.S. Pat. No. 3,353,515, issued Nov. 21, 1967. Subsequent to the application and curing of the coating on the cans, the cans may either be immediately palletized for delayed processing or they can be subsequently continuously processed while being relatively corrosion proofed.

SUMMARY OF THE INVENTION

Accordingly, it is proposed in accordance with a preferred embodiment of the instant invention that an organic, water-based and water soluble or at least water dispersible hydrophilic, relatively clear coating material be simultaneously applied in a single operation to all chemically precleaned but non-chromate phosphate treated surfaces of a metal can body. The coating is applied during a selected yet relatively small amount of residence time at a coating station that can be incorporated in a continuous can processing line. This single coating can serve both as the inside and outside coating for a metal can, such as a seamless aluminum or steel, e.g., tin free, tin plate or blackplate can, and is preferably a non-varnish organic polymeric coating which is water based and water soluble or at least water-dispersible and wherein the organic material may comprise from about 5% solids by weight to as much as 30% to 35% solids by weight of the coating constituents.

When the same single coating is used for the inside and outside can coating and separate bottom varnish operations, at least one inside spray coating operation and the subsequent coat baking operation and possibly one outside coating and oven baking operation, all of which today are required for certain cans, can be either avoided or minimized.

Consequently, whereas several can coating curing operations plus the usual can drying operation required after the acid wash, all at elevated temperatures are normally required today in most seamless metal can manufacturing operations, a significant number of these elevated temperature operations including the aforesaid container drying operation that can be the severest heat exposure operation can be eliminated by use of the instant system. For example, the overall time that a container being fully processed may be exposed to elevated temperatures as high as 475° F. oven air temperature and a 440° F. container metal temperature can now be reduced by use of the instant treating system from about 20 minutes overall to about 14 minutes overall with only several minutes being required per heating oven, because of the elimination of certain heating steps and because there can be a reduction in the residence time in any given heating or coating curing oven used with the instant system.

The coating materials used should be advantageously readily flowable and of low viscosities, etc. and being water based and water soluble or at least water dispersible can be applied by appropriate spray equipment or the like to be described that may be associated or integrated with a can washer of the type shown in the aforementioned U.S. Pat. No. 3,262,460. By virtue of the coating materials being readily flowable and of low viscosities on the order, for example, of from 10 to 30 seconds flow out time through a No. 4 Ford cup, at about 77° F. they are susceptible of being readily dispensed or sprayed onto the can surfaces. In this connection, the nozzles used to apply the coatings are preferably full cone pattern, jet type, flooding nozzles that literally bathe and immerse the can bodies in the coating materials and the spray cone patterns of adjacent nozzles are preferably advantageously overlapped.

Since the aforementioned coating materials are generally fully compatible with the other wash and rinse waters of the can washer, etc., a common waste and carry-off system can be advantageously used to dispose of the coating residue as well as the wash and rinse water residues thereby helping to avoid or at least substantially minimize waste water environmental problems present today. In other words, the particular can coating materials envisioned would be such that one could use the standard waste water treatment facilities presently used today in various can operations, e.g. two-piece can operations, in the disposal of the same. A further advantageous feature of the instant invention residing in the use of coatings that are preferably water soluble and have relatively low viscosities and are applied by flooding nozzles is the fact that the coatings will generally substantially uniformly wet the metal surfaces of a can.

Although the invention will be discussed with particular reference to its use in a continuous container processing line involving equipment of the type shown in U.S. Pat. No. 3,262,460 above, it can be used equally well in batch processing systems and various types of equipment can be used to apply the coatings in the can processing operations involved in addition to or in lieu of the apparatus to be specifically disclosed and illustrated herein. It is contemplated, for example, that the inventive concepts proposed can be used in systems wherein the fluid coatings help to propel cans through the coating zones at the same time they cost the cans such as in the case of the equipment shown in U.S. Pat. No. 3,704,685, issued Dec. 5, 1972.

The organic coating materials proposed utilize readily available spraying equipment along with standard dryers or baking ovens, which can be readily incorporated in a can line and which will promote rather than interfere with the general flow of the materials in the overall can line. The length of time that the cans are to be exposed to the coating sprays, plus the residence time needed in the baking ovens are to a large extent all dependent upon the particularly coating materials used although, when compared to prior art practices, such times generally will still be less than in the past. Further, since the materials are applied in such fashion that they will substantially uniformly wet the metal can surfaces and adhere as a generally uniform layer to the inside and outside surfaces of a can body, the coated interior and exterior can surfaces will be substantially free of pin holes or holidays and the resultant uniform, thin, coating film, once it is baked on, will provide the can with an efficient abrasion resistant plastic armor.

A particular advantageous feature of the instant system involving use of water based and water soluble or at least water dispersible coatings is that the coatings can be baked on with minimal heat exposure. This can be significant in the processing or treating of metal containers of relatively thin walls such as those of 0.0048 to 0.012 inch thickness depending on can size, and when made out of aluminum alloys in an extra hard temper range, such as an alloy designated as a 3004 aluminum alloy of H-19 temper in accordance with existing 1973 Standards of the Aluminum Association of America. Work hardened metal containers, such as aluminum alloy cans made out of such H-19 temper stock, are eminently desirable because of the strength afforded by such tempered stock even in thin gauges. Excessive heating of such an aluminum container, however, can result in a partial anneal of the same, which lowers its strength.

In other words, the longer a coated metal container such as an aluminum container made out of the harder temper alloy is exposed to elevated coating curing temperatures, etc., the softer the material will become and by reducing the temper, the yield and tensile strengths of the alloy would ordinarily also decrease. While this can be advantageous for further working of the metal, it can be detrimental as far as retaining the desired overall and final wall strength of the container. As a consequence of the relatively rapid and minimal curing or heating of a coated hard temperated aluminum alloy can in the practice of the instant invention in any given oven, the amount or degree of annealing of the can is for all practical purposes negligible or minimal. Thus after curing of the can coating there is a substantial retention of the best physical and mechanical properties in the container particularly when made from hard temper or extra-hard temper aluminum alloys, whereby an improved coated metal container such as one made of an extra hard tempered aluminum alloy can be produced.

In the proposed can treating system, the coating of all exposed can surfaces including can bottoms and walls takes place substantially simultaneously in an improved fashion. The coating material streams or sprays are preferably emitted as full cones from opposed arrangements of jet cone spray elements and at or close to room temperature, i.e. at about 60° F. to 80° F. When so dispensed the coatings spray the bottoms and walls of the containers both inside and out simultaneously and advantageously act to stabilize, orient and maintain the container bodies in the desired and relatively fully controlled coating receiving positions and at the proper angular disposition relative to the spray elements as the container bodies in a preselected fashion through the coating applicator station. The high fluidity, low viscosity and solubility of the coating materials minimize nozzle clogging while allowing the materials to reach even the most intricately shaped sections in the bottom and/or sidewall of a can. The simultaneous application of the coating to both the inside and outside can surfaces takes place most opportunely right after the can has been washed and rinsed and with all the can surfaces being preferably in a moistened condition and before the can surfaces can be deleteriously altered by contaminants and/or oxidation.

In a preferred embodiment of the invention, the inside and outside applied coating should have a minimal uniform thickness build up on the covered can surfaces of from about ½ milligrams per square inch up to 10 milligrams per square inch. The coating material used should desirably have an affinity for metal and in a preferred embodiment of the invention a metal provided with a moisture layer and be subject to curing at elevated metal temperatures on the order, for example, of from 350° F. to as much as 475° F., which are the usual elevated temperatures to which the cans will be exposed during the baking on of the coatings in a preferred practice of the invention. It is to be understood, of course, that the particular elevated curing temperatures, and time thereof to be used will depend upon the coatings employed and the particular metal and alloy thereof involved.

In addition to having the appropriate viscosity, solubility or at least water dispersible properties, the coating materials should be readily manageable and have appropriate properties as regards lubricity, abrasion and scuff resistance, acid and alkaline resistance, as well as taste, flavor and odorfree properties sufficient to meet Federal Drug Administration regulations currently in force plus having resistance to boiling water, non-toxic, light-fast and tenacity characteristicis to all of which can be finally added good formability. This latter property is particularly significant since the ultimate coating, once it is applied, should not tend to craze or break as the cans are necked in or flanged during the later lid application, or open end forming or post forming or after various decorating and varnish coatings have been applied.

A coating material found to have all or substantially all of the aforesaid advantageous characteristics and/or properties is a relatively low molecular weight polymer in an aqueous medium possessing at least one hydrophilic group, the polymer being capable of substantially uniformly wetting the metal can surfaces as a result of possessing the hydrophilic component. This coating will be referred to hereinafter throughout the specification and claims as a free-flowing coating or coating material. Three such free-flowing coatings found to be satisfactory are (1) a one component organic water based polyester epoxy type coating produced by HCI Coatings Division of the Whittaker Corporation of Colton, Calif., under the experimental number designation 85C5; (2) a one component organic water based acrylic type coating produced by the Celanese Chemical Company, Lousiville, Ken., under the experimental number designation X-1431-B; and (3) a one component organic water based epoxy type coating produced by the Dexter Midland Corporation of Waukeegan, Illi. under the experimental number designation LA67-3. The flow rate of each of these three coatings through a No. 4 Ford cup at 77° F. was on the order of 12–20 seconds. The polymer content by weight of each of the coatings was approximately 20% and the average molecular weight of the coatings was in the range of about 200 to about 30,000 with a preferred average molecular weight range from about 800 to about 15,000. The polymers characterized hereinbefore were found to be suitably water soluble or at least water dispersible.

DETAILED DESCRIPTION

Figure 1:
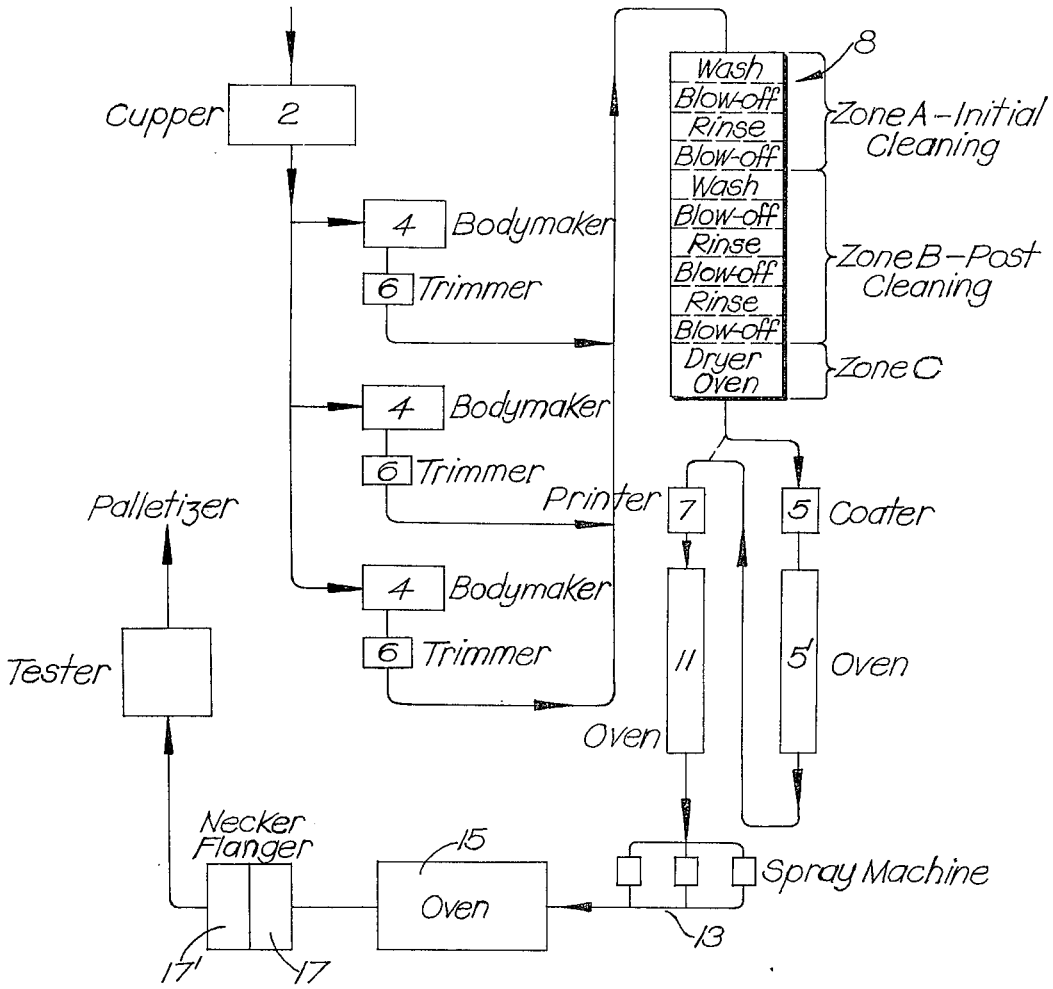
FIG. 1 is an overall schematic flow diagram of a typical and fully integrated seamless, draw and iron can line in use today.

With further reference to the drawings, FIG. 1 illustrates a typical fully integrated and closed end or seamless can body manufacturing facility in operation today, e.g., a draw and iron can bodymaker operation, involving a standard metal cupping press 2 that is continuously supplied with metal sheet, such as tin plate, tin free steel, black steel plate or 3004 H-19 hard tempered aluminum sheet of the proper gauge from a well-known uncoiler device (not shown). Shallow drawn metal cups from press 2 are subsequently selectively fed to one of the can bodymakers 4 located in the can line. Typical can bodymakers useable in the system are shown in U.S. Pat. No. 3,314,274. From the bodymakers, the cans move to trimmers 6 where the earred open ends of the cans are trimmed. These trimmers can be of the type shown, for example, in U.S. Pat. No. 3,425,251. After trimming, the trimmed cans can then be fed to a washer 8 such as a washer device shown in aforementioned U.S. Pat. No. 3,262,460. Since this latter patent discloses a typical washer used today, the instant system will be described with particular reference to such a washer.

As the cans or containers move through the washer stations of Zone A they are initially washed and rinshed in cold or warm water containing suitable detergents that remove the oils and other residuals that form or remain on the can as a result of the metal rolling and/or draw and iron, trimmer and other handling operations in several wash and rinse cycles. After each wash and rinse part of the overall operational cycle the residual wash and rinse water is blown off by suitable devices as the cans pass along the processing line, all as shown in U.S. Pat. No. 3,262,460. The can bodies X move through washer 8 in a generally inverted position with the closed end up and the open end down on an open meshwork conveyor 10 of the type shown, for example, in U.S. Pat. No. 3,726,020. While in this position, the interior of the cans can be exposed to the action of the wash and rinsing jets or nozzles located under the open net or meshwork conveyor 10 as well as to that of the jets located above conveyor 10. The individual links of a conveyor 10 are usually made out of stainless steel and they are pivoted or joined together by appropriate pin elements to form a flexible conveyor web.

In the case of the typical can line of FIG. 1, a single meshwork conveyor is used for conveying the can bodies X through Zones A, B and the drying oven of Zone C. In the instant invention, a plurality of such open meshwork conveyors are advantageously used and these conveyors are interconnected or interlinked in a unique fashion by improved dead plate elements, all to be described.

In the processing line of FIG. 1, the inverted open end cans on conveyor 10 move through a series of successive wash, rinse and blow-off stations in Zone A and, if desired, thre can be several of each. After the various initial wash and rinse operations, the cans X move into a Zone B sometimes referred to as a post cleaning zone and through an acid washer station where a precoating or caustic etching operations takes place. This precoating is applied to the inside and outside surfaces of the cans in order to size or prime all surfaces of the can bodies so that they will be receptive to further inside and outside coatings and/or decorating or printing inks. After the cans have been acid washed and rinsed, they may be and usually are subjected to a deionized water treatment before moving to a drying oven section C for ultimate heating and drying. The chemically cleaned, dry can bodies X are then ready for ultimate decoration at further points in the line.

With further reference to the standard can line of FIG. 1 and depending upon the individual customer's requirements, the can bodies may be externally coated at a standard coater station 5 and the coating baked on in oven 5′, all in a manner well known in the art and then printed by means of a standard printing device or conveyed directly to the printer 7 while bypassing coater 5 and oven 5′. The optional external coating to be applied normally involves the application of pigmented white or colored enamel and the can bodies X are fed onto the mandrels of such a coater and indexed to the proper positions for this purpose. The enamel is applied by the normal roller coaters and the coated can then removed from coater 5 and passed on to oven 5′ where the coating is baked on.

The printing or decorating at station 7 can be accomplished with up to four-color offset-type equipment. In this case, the can bodies X are fed onto the mandrels and the decoration applied by typical dry offset methods followed by further curing of the decorative materials in a curing oven 11. The decorated cans depending on the particular metal used and products to be packaged can be next subjected to the application of internal organic spray coatings. These coatings are baked on utilizing the requisite number of baking cycles in a bake oven 15. All such coatings are normally applied under high pressure and elevated temperatures at one or more stations 13 to assure coverage of all the interior surfaces of the can bodies X prior to movement of the can bodies to the oven 15. From oven 15 the can bodies next move to necking and flange forming stations. The necking of the open end of the can is performed at station 17 in a standard rotary machine that contacts the body sidewalls at the open end of the can. The rotary machine forms an indented and reduced diameter wall in the can adjacent its open end and from necking station the can moves to a flanging station 17′ that forms the end flange to the selected dimensions for ultimate attachment to a typical can top.

Throughout the entire process, tests and checks are constantly conducted to eliminate defective can bodies X. The final can body audits are made prior to palletizing and packaging of the finished can bodies. The testing can include, for example, an standard vacuum set up to detect any body pin holes or flange defects and defective bodies are passed as rejects to bins for scrap recovery, while acceptable can bodies are conveyed for collection onto pallets.

The can testing system to be described and as contemplated by the instant invention is concerned in a preferred embodiment thereof with making significant changes in the Zonal area B of the can line washer section 8 by substituting an improved can coating station for the acid rinse or or caustic etching operations plus rinse and blowoff, etc. previously used. A further modification can involve the addition of a can coat drying and bake oven station disposed closely adjacent the improved can coater station or a modification of the dryer oven of Zone C to upgrade its heating capabilities and, if desired, move it closer to the end of Zone B. In any event, for the purposes of the applications, Zones B and C in the improved system will be considered as being merged into a single Zone B'.

Figure 2:
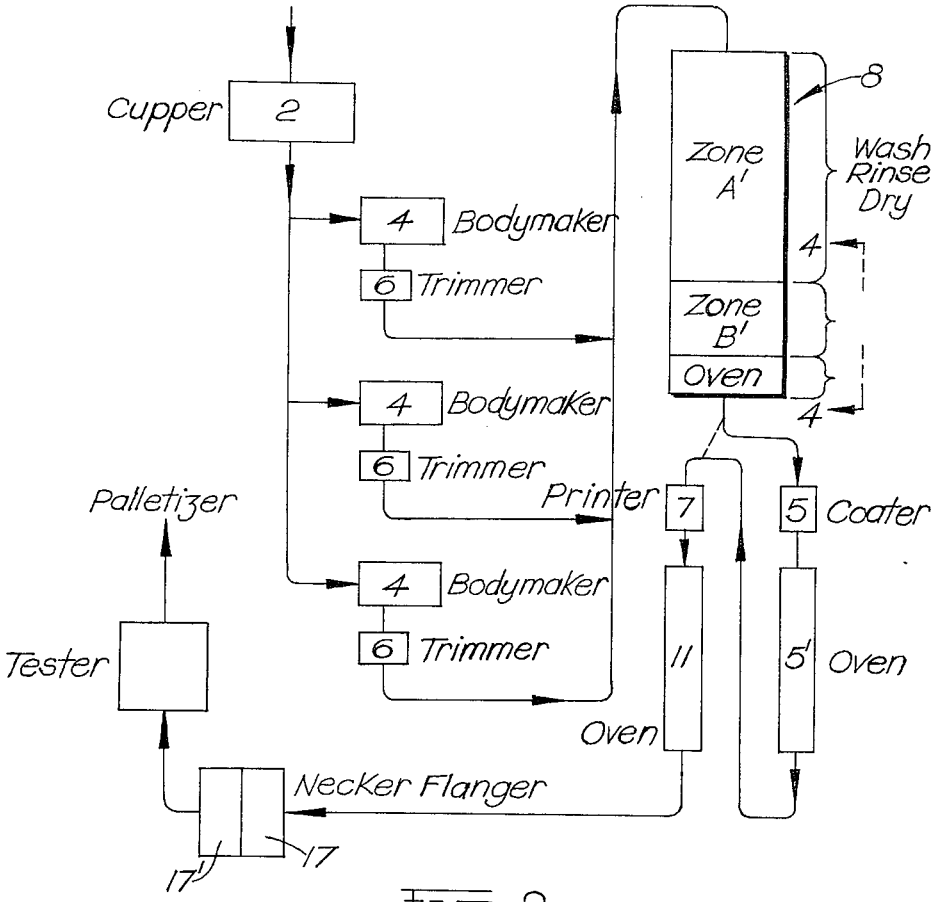
FIG. 2 is an overall schematic flow diagram of the same can line of FIG. 1 but with certain sections removed therefrom by virtue of the improved can coating and washing operations or stations of the instant invention that can be incorporated into such a can line.

In the instant can treating or processing system, the cans advantageously pass through several basic treatment zones or sections prior to the final decorating of the outside surfaces and any post can forming, e.g. necking and flanging. Thus, as indicated in FIG. 2, the first zone will be considered as comprising the usual or initial wash and rinse Zone A' wherein the can that has just been produced, for example, on the draw and iron press and trimmed can be washed and rinsed so that the rolling mill and/or press oil and other residue, etc. remaining on the can is appropriately washed off and removed from the can and a clean can then readied for the improved coating and baking operations in Zone B'. Inasmuch as most of the washing, rinsing and blowoff operations that are performed in Zone A' can be substantially of the type shown and described in U.S. Pat. No. 3,262,460, no detailed discussion of such wash and rinse and prewash and rinse operations is believed necessary and reference may be made to the patent for further discussion of the same. Conversely, since the instant invention is concerned primarily with the operations or treatment of the can bodies in Zone B', it will be discussed with particular reference to Zone B' and as illustrated in detail in FIGS. 2, 4, 5, 6 and 7.

Figure 4:
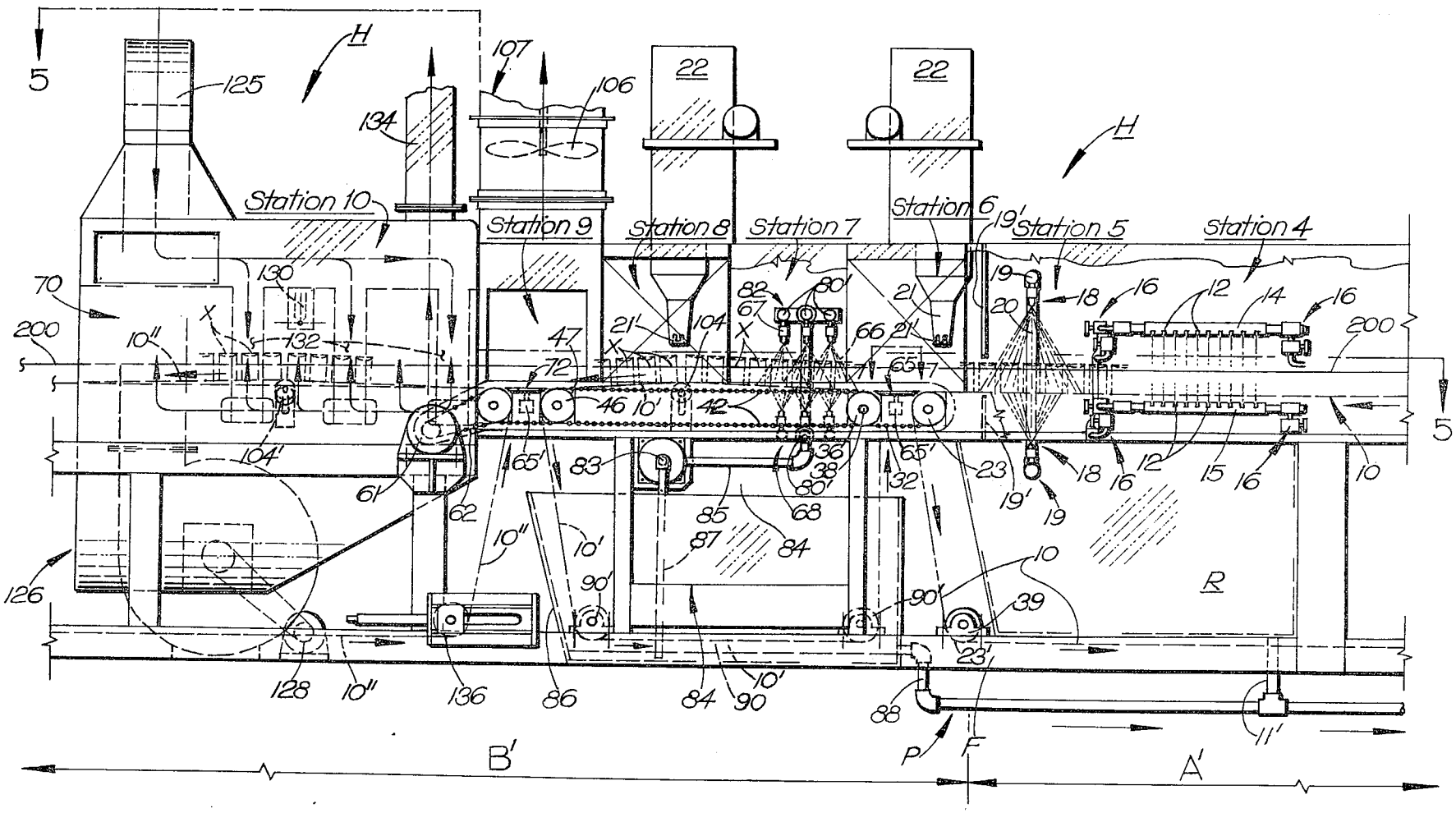
FIG. 4 is a side elevational view generally taken along the line 4—4 of FIG. 2 with parts added, other parts removed and other parts broken away and illustrates in some detail the can coating and drying stations, etc. of the improved container treating system of the instant invention.
Figure 5:
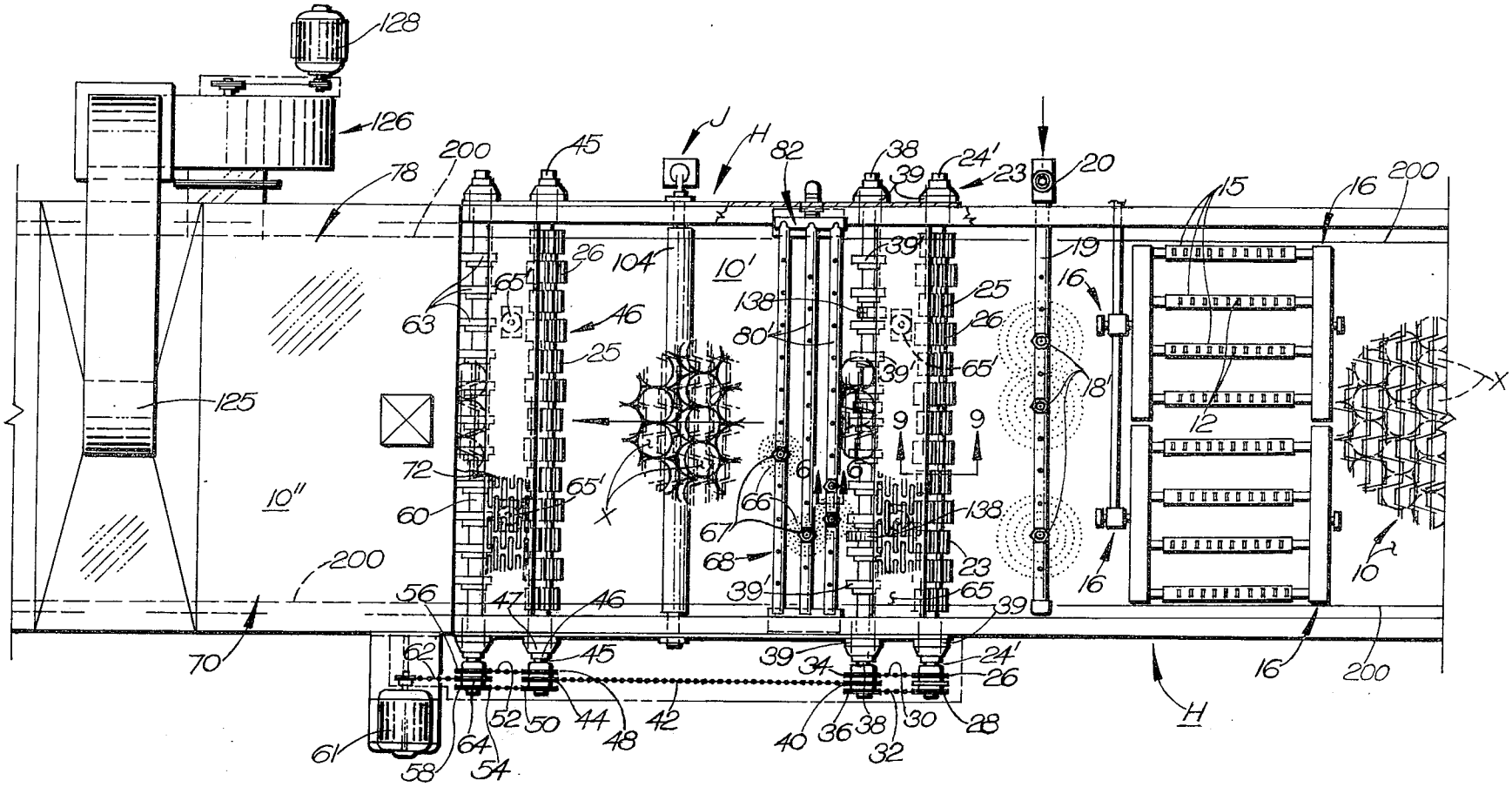
FIG. 5 is a fragmentary plan view with parts removed and parts added of the portion of the can processing system shown in FIG. 4 when taken generally along line 5—5 thereof.

Accordingly, with further reference particularly to FIGS. 4 and 5 of the drawings, it will be observed that in Zone A' the closed end can bodies are arranged in a well-known manner and in an inverted fashion on an open meshwork conveyor 10 and carried by conveyor 10 through several standard wash, rinse and blowoff stations, such as a prewash in a first station plus blowoff, a secondary wash in the second station plus blowoff, and a first rinse at a third station plus blowoff. Also included within Zone A' may be a secondary rinse at a fourth station plus blowoff, if desired but not shown, followed in a preferred embodiment of the invention by a deionized water bath at a fifth station where the can bodies are subjected to the deionized water bath applied at appropriate temperatures from the opposed upper and lower lines 18 of spray jet nozzles. The fourth and fifth stations are conveniently illustrated at the right-hand section of FIG. 4 and may be considered as the final part of Zone A'.

At station 4, the wash and rinse waters are ejected onto the various inside and outside sufaces of can bodies X disposed on open meshwork conveyor 10 at appropriate temperatures by way of the slotted nozzles 12 of the type, for example, shown in U.S. Pat. No. 3,262,460 and fitted in upper and lower opposed and elongated pipes 14 and 15 located parallel to the path of travel of conveyor 10 fed from common manifold and valve arrangements 16 well known in the art. All of the stations to be described including stations 4 and 5 are enclosed within a conventional tunnel-like framework and hooded housing assembly H.

As the can bodies X pass from station 4 to station 5, they may be subjected to a blowoff operation as aforesaid and a primary purpose of which is to remove excess water that may be trapped in the inverted concave bottoms of the can bodies being treated. The individual nozzles 18' at station 5 are affixed to upper and lower elongated cross pipe manifolds 19 that lead to a common source pipe 20 in a manner well known. Excess water from stations 4 and 5 is collected in the receptacle R that can be connected by pipe 11' to main sewer piping P. The nozzles 18' can be of the general type manufactured and sold by the Spraying Systems Company of Bellwood, Illinois, under Model Designation ¼ HH SS-6.5. They are of a flooding spray type, which apply the material at station 5 generally in a full cone spray pattern at high volumes of approximately 6.5 gallons per minute and at approximately 10 psi pressure at normal room temperature. The full spray cones of the individual jet nozzles 18' are arranged at a transverse angle to the path of flow of the cans X on the conveyor 10, preferably at a 90° angle, and their spray cones overlap. These nozzles inundate the can bodies X and give them a final cleaning prior to entrance into the coating Zone B'.

The relatively large openings in meshwork conveyor 10 permit the deionized water to contact and thoroughly uniformly wet the inside as well as the outside surfaces of the cans. The action of top and bottom sprays at the same time serve to stabilize the containers on the conveyor 10 and to keep the containers in their proper inverted balanced and upright positions just prior to passage to the next station which can be a blowoff station 6 isolated from station 5 by a standard baffle arrangement 19'.

The endless belt conveyor 10 can terminate within the conventional blowoff station 6 of the type shown in U.S. Pat. No. 3,262,460 and this blowoff station may be provided with the usual blowoff duct 21 that terminates above conveyor 10 in a plurality of elongated mouths formed by the elongated V-shaped bridge elements 21' welded to the wall sections of duct 21.

Although the can bodies X may be presented to the coating applicators in a dry state a preferred embodiment of the invention contemplates that air from a blower and main duct assembly 22 will move in a controlled fashion through the mouths of duct 21 and act to wipe excess rinse and deionized water from the surfaces of the cans being processes and in particular excess water trapped in the can bottoms as previously noted, while still leaving controlled amounts of water on the can surfaces. Small desired amounts of such water, etc. are allowed to remain on substantially all of the washed and rinsed can surfaces including the bottom surfaces of the can bodies to form an advantageous can surface moisture layer. This layer serves to enhance the interfacial surface tension characteristics of the various metal surfaces of the cans and adhesion of the coating to the cans during the subsequent coating application. For example, it has been found by having a thin water film or moisture layer on the order of a few hundredths of mils thickness, that the adhesive affinity of the metal surfaces to the subsequent water based coatings K can be measurably improved depending upon the particular coating material used.

The exit end of conveyor 10 is trained about a drive roll 23 provided with waffle-like projections to be described. In addition to waffle drive roll 23, the endless meshwork conveyor 10 is further trained about the usual guide and idler rolls 23', some of which are not shown, whereby conveyors 10 can run the entire length of Zone A' and extend for a short distance into Zone B', all within assembly H. All of rolls 23 and 23' are mounted in suitable standard bearing assemblies 39 affixed to framework F part of the assembly H for the equipment making up the washer, rinse, coating and oven apparatus, etc.

Figure 8:
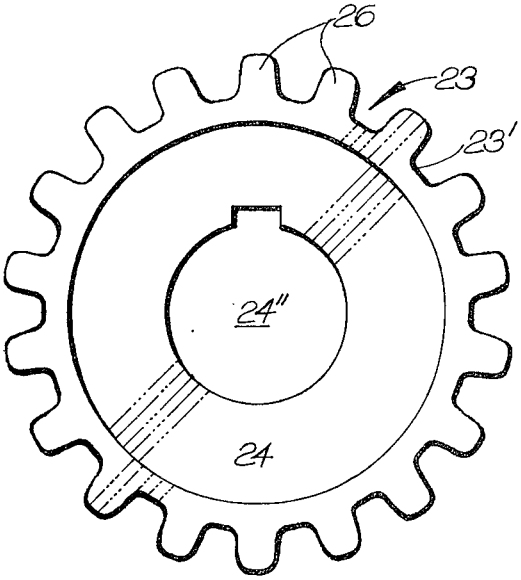
FIG. 8 is an end view of a typical waffle-type drive roll shown in some detail in FIG. 10 and used in the conveyor mechanisms of the instant invention.
Figure 9:
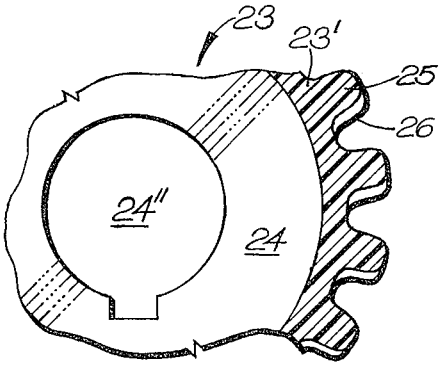
FIG. 9 is a fragmentary cross-sectional view of a portion of the drive roll shown in FIG. 10 when generally taken along line 9—9 of FIG. 5.
Figure 10:
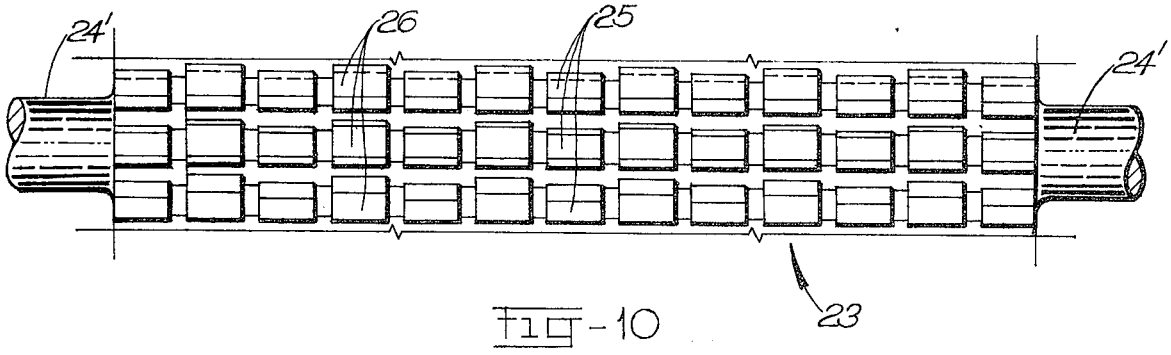
FIG. 10 is an elevational view of a drive roll and illustrates the waffle pattern surface of the drive roll.

Various portions of the waffle drive roll 23 are shown in FIGS. 8–10. This roll which can be custom manufactured is generally of hollow, heavy plastic cylinder construction and closed off at its ends by suitable metal disc elements 24 appropriately secured to the outer waffle cylinder 23'. Disc elements 24 contain key openings 24'' for receiving an elongated spindle 24' locked to the roll end discs by the usual spline pin elements (not shown). The waffle-like outer surface of the roll cylinder is provided with alternate and somewhat offset small and large sets of drive teeth 25 and 26 that are adapted to fit in successive fashion within the alternate, offset and successive openings of the meshwork conveyor 10 during rotation of roll 23 for the purposes of driving the same during rotation of spindle 24' in a smooth fashion.

With particular reference to FIG. 5, it will be noted, that one end of roll spindle 24' carries a pair of sprockets 26 and 28. Trained about sprockets 26 and 28 are appropriate chains 30 and 32 and these chains are likewise trained about additional sprocket elements 34 and 36 affixed to a sprocket shaft 38 also mounted in the usual roll bearings 39 as aforedescribed in the framework F of overall assembly H. The intermediate section of shaft 38 carries a plurality of rollers 39' which support the secondary open meshwork endless conveyor 10' similar in construction and operation to conveyor 10. Conveyor 10' is designated as the coating conveyor and it is used to advance the can bodies X through the can coating station 7 in Zone B'. Affixed to shaft 38 intermediate the sprocket elements 34 and 36 is a further sprocket 40 about which one end of the chain drive 42 is trained. The other end of chain 42 is affixed to a sprocket 44 attached to the spindle 45 for another waffle drive roll 46 of the same general type and construction as previously described roll 23. Roll 46 is likewise mounted in suitable bearings 47 similar to bearings 39 attached to framework F of assembly H and roll 46 can have teeth 25 and 26 adapted to engage and drive conveyor 10'. Spindle 45 is similar to spindle 24' and carries additional sprockets 48 and 50 about which drive chains 52 and 54 are trained with chains 52 and 54 being further trained about another series of sprockets 56 and 58 secured to a drive shaft 60. Shaft 60 is ultimately interconnected by means of the standard main chain or belt drive 62 fitted about drive sprocket 64 secured to shaft 60 to a main drive motor 61 in a manner well known in the art.

As in the case of shafts 38, shaft 60 carries a plurality of conveyor support roller elements 63 at the intermediate section thereof. Roller elements 63 can be provided with teeth analogous to the teeth 25 and 26 of roll 23 or 46 and they support and act to drive the tertiary open meshwork endless conveyors 10''. Conveyor 10'' supports and advances the coated can bodies through a final drying oven 70 at a station 10 and is of a construction similar to that of conveyors 10 and 10''.

By interconnecting all of the endless conveyors 10, 10' and 10'' to each other and to a common drive, all of the conveyors can be advantageously made to operate at substantially the same rate of speed in processing the can bodies X along the can line. This can be of advantage in operating the line and effecting a substantially uniform and smooth continuous flow of can bodies X through the overall processing line of Zones A' and B' and the coating baking oven 70 located at the end of Zone B'. As indicated by dotted lines in FIGS. 4 and 5 continuous wire barriers 200 are strung above and along each of the conveyors 10, 10' and 10''. These barriers 200 keep the moving cans within the confines of the various stations of housing assembly H and prevent the cans from spilling out or off of the equipment as they pass from station to station.

Advantageously located between waffle roll 23 and shaft 38 in the area of blowoff assembly 21 is what is known in the art as a "dead plate" 65. As indicated particularly in FIG. 7, plate 65 is apertured and serves as a station transition device or transfer surface whereby inverted containers X, in moving across the plate, which can be vibratory or stationary and affixed by suitable means (not shown) to framework F of assembly H, are passed in a relatively smooth fashion and inverted upright condition from primary open meshwork conveyor 10 to secondary open meshwork conveyor 10'. Conveyor 10' advances the containers X through the station 7 containing the opposed banks 68 of coating spray nozzles 67 to be described and past another blowoff station 8 of assembly H for removing excess coating material K until it terminates adjacent another dead plate 72 that can likewise be stationary or vibratory. Plate 72 acts to transfer the coated cans from secondary conveyor 10' onto the tertiary open meshwork conveyor 10'', which operates to transfer and move the coated cans through vapor removal station 9 and then through the final curing oven station 10 of housing assembly H in a manner all to be described. Several open meshwork conveyors 10, 10' and 10'' are used instead of a single conveyor because, if a common conveyor were to be used to transfer and move the open ended and inverted can bodies through all portions of Zones A' and B', and oven station 10 various problems would be involved such as a baking of the coating materials that drip onto the conveyor 10' at the coating station 7 onto conveyor 10' in the baking oven.

Figure 7:
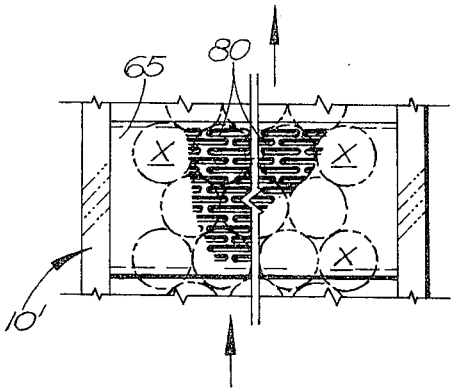
FIG. 7 is a broken, partial plan view taken generally along the line 7—7 of FIG. 4, when rotated 90° clockwise, and illustrates the top surface of a dead plate, which acts as a transfer mechanism between two adjacent open mesh conveyors used in the system.

The dead plates 65 and 72 can be made of stainless steel and they are illustrated in some detail and in plan in FIG. 7. Each plate is generally comprised of a series of elongated perforations 80 located in parallel rows and the elongated perforations 80 in one row are generally offset with respect to the perforations in an adjacent row. These perforations can measure about 1 inch along their major axis and about one-fourth inch along their minor axis. The edges of the dead plates 65 and 72 at the point where they overlap the individual conveyors 10 and 10', etc., e.g. at the point of actual transfer of the can bodies X from one of the conveyors 10, 10' or 10'' to the next conveyor, are generally sharp or knife-point so that they can be arranged as close to the conveyors and in proper overlapping relation as is practical. The openings 80 in the dead plate 72 tend to act as scrapers in removing and wiping off excess coating materials K from the open mouth can edges of the can bodies X as they move across the dead plate 72. In an advantageous embodiment of the invention these plates may be mounted so as to be able to vibrate slightly by means of bin type agitators 65' connected thereto in a well-known manner in the art to assist the movements of can bodies X thereacross. Although not shown it is to be understood that appropriate endless open meshwork hold down conveyors similar to those of U.S. Pat. No. 3,291,143 can be mounted, if necessary, at various points throughout housing H, such as above the dead plates 65 and 72 for lightly engaging the closed ends of the inverted can bodies with the approximate amount of pressure to insure proper passage of the containers across the dead plates 65 and 72.

The coating operation at station 7 will now be described. As successive can bodies X are slowly and smoothly advanced or pushed across dead plate 65 by additional oncoming can bodies being discharged from conveyor 10 and possibly by an assist from the slight vibration or agitation of dead plate 65 by vibrator or agitator 65', they move onto conveyor 10' which carries the can bodies through coating section 7 of Zone B' and past the opposed lines of piping 68 located below and above the conveyor 10' to which the individually adjustable jet nozzles 67 are attached. These jet nozzles can be of the same full cone spray type as nozzle 18' for the deionized water.

Figure 6:
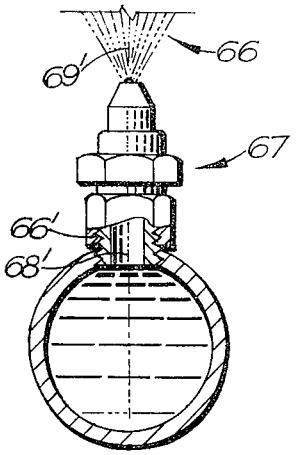
FIG. 6 is a cross-sectional view of a typical full cone flooding nozzle device used in applying the coating materials to the closed end can or container bodies when taken generally along line 6—6 of FIG. 5.

In any event, and as indicated more particularly in FIG. 6, the particular design and arrangement of the adjustable nozzles 67 should be such that the individual coating spray pattern produced by each nozzle 67 is a full spray cone 66, that results in a substantially immediate inundation, flooding or deluging of the cans with the water dilutable coatings K simultaneously from both sides of the open meshwork conveyor 10' by the opposed banks of overlapping spray cones 66 from nozzles 67. The relatively low viscosity and solubility of the free flowing coating materials K at about or in a preferred embodiment of the invention somewhat below room temperatures provides for a relatively fast can coating application and the can bodies X depending on metal composition and surface condition need be immersed for only about 10 to 30 seconds per can of coating station 7 in order to be provided with a coating that is substantially uniform on all of the can body surfaces on the order of from ½ milligram per sq. inch to about 10 milligrams per sq. inch depending on volume of coating material flow, speed of conveyor 10', etc.

The sprays from the jet nozzles 67 perform a number of significant functions. Firstly, the hydraulic pressures of the sprays from the opposed nozzles 67 on the order of 40 psi together with flow volumes on the order of 6½ gallons per minute per nozzle generally stabilize and maintain the cans upright on the conveyor 10' by virtue of their flooding action and, as a consequence, help to orient the cans X relative to the nozzles 67, whereby the cans X are fully receptive to the coatings K being applied. These nozzles 67 as well as nozzles 18 at station 5 are threadedly attached to the pipe stubs 66' and they can be adjustable to change the volume from as little as 0.011 to as much as 7.0 gallons per minute and at various pressures depending on the results desired. Secondly, they apply the coatings in full cone spray overlap patterns in order to obtain substantially instantaneous and full can surface coverage from the beginning of coating applications. For this reason, it is desirable that the nozzles 67 in one bank or one line of nozzles be somewhat offset with respect to the nozzles 67 in another adjacent bank or line on both sides of the conveyor 10' of which is indicated in FIG. 5. Thirdly, the axis 68' of each nozzle 67 is generally set at a transverse angle of about 90° to the normal path of travel of cans X and conveyor 10'. This also means, that the central axis 69' of each spray cone 66 coincides with axis 68' of a nozzle 67 whereby the full force of the coatings, as they are applied, acts in a direction generally transverse to the path of movement of the cans but parallel to the main longitudinal axis of the can bodies per se so as to prevent or minimize overturning of the cans during the coating operation. This can be particularly important in the case of light weight aluminum cans that weigh very little, such as 17 to 19 grams for a standard 12 ounce aluminum beer can. In any event, all of the above operational procedures means that the coating of both sides of the can bodies X takes place simultaneously and that a minimal residence time of a can body X is required at the can coating station 7.

The coating material K for the main top and bottom nozzle pipe lines 80' is supplied to the lines 80' and nozzles 67 from the main manifold pipe line assembly 82 of conventional design that leads to the pump 83 employed to pump coating material from the usual holding reservoir 84 via line 85. The coating material can be advantageously held in reservoir 84 at holding temperatures of 45° to 70° F. to avoid or minimize frothing, etc. which may interfere with the application of the coating materials to the cans X. Pump 83 is also connected to the bottom of coating drip tank 86 located below the upper flight of conveyor 10' by means of line 87. The bottom of tank 86 can be connected by appropriate piping 88 along with prior piping 11' from rinse water tank R to the main sewer line P whereby, if permitted by environmental control agencies, the coating materials residue and drippings can be flushed into the sewer lines along with the rinse and wash waters from Zone A', etc. without in most instances the need of adding any special neutralizing material thereto. Since conveyor 10' is of open meshwork, the excess material that does not attach itself to the can bodies X can easily drip down through the conveyor into reservoir 86 where it is either collected for recycling or ultimate discharge by means of conduit 88 to the plant septic tank or sewer line as aforedescribed. Because of the low viscosity, solubility and high flowability characteristics of the coatings used at about room temperature, i.e. about 60° F. to about 80° F. the tendency for the coatings to stick to the conveyor meshwork 10' is minimized. The bottom flight 90 of conveyor 10' is elevated slightly above the normal residue level of the coating material K in reservoir 86 to minimize coating pickup by way of the usual idler roller assemblies 90' mounted in suitable bearing assemblies.

In an advantageous embodiment of the invention, it has been found that the preforming of the can body bottom at the time of the draw and ironing operation can work to advantage in the coating operation. This is because the concave can body bottom, which faces the topmost nozzles 67, provides a wall or an indented surface which, when struck by the flood of coating materials, helps to balance, stabilize and keep the can bodies in the desired hydraulically balanced and spray receiving position, e.g. in an upright and erect position on the conveyor 10'. This is true even when there are slight variations in line pressures from a nozzle 67 to a nozzle 67 due to a minor equipment malfunction, that can occur after prolonged periods of operation. In the case of drawn and ironed aluminum cans which weigh but a few ounces and require very little force to be tipped over, any system feature that will help to orient, balance and maintain proper orientation of the cans during coating can be significant. For this reason, it is preferred that the coating material K be emitted from the topmost nozzles or those directly opposed to the can bottoms at a pressure slightly in excess of that used for the bottom nozzles whereby the hydraulic pressures of the opposed upper and lower nozzles 67 are deliberately made disproportionate and with the pressures of the coating materials from nozzles 67 located above conveyor 10' being slightly in excess of the opposed lower nozzles 67.

In order to maintain the desired full or solid flow cone of liquid coating material K from each nozzle 67 required during the coating operation so as to obtain the desired can surface flooding and wetting, it has been found that preferred pressures for nozzles 67 should be on the order of 40 psi together with nozzle discharge rates on the order of 6½ gallons per minute and with pressure of the topmost nozzle slightly exceeding the lower nozzle pressures. As noted previously the wetting of the can surfaces during coating can be aided by allowing a certain amount of moisture to cover the surfaces of the cans as the cans are advanced to the coating station 7. In other words, it can be advantageous, depending on the coatings used, for the metal can surfaces to carry, what may be termed a preconditioning moisture layer, such as that acquired at station 5, which improves the interfacial surface tension characteristics of the can surfaces and thus promotes the adhesion of the final coating to the metal surfaces of the can during the coating operation.

After the coating operation at station 7, the cans move by conveyor 10' through a blowoff station 8 similar in structure and function to station 6 at which excess coating material is forced by an appropriate air stream from ducts 21' off of the cans and down through the open meshwork of conveyor 10' into the tank or reservoir 86.

In a further advantageous embodiment of the invention and as indicated particularly in FIG. 4, it will be observed, that located almost immediately below the blowoff conduit sections 21' of blowoff station 8 is an adjustably mounted arch roll 104. The ends of arch roll 104 are mounted in appropriate bearing assemblies and these bearing assemblies can each be connected to suitable jacking devices J (only one of which is shown) in a well known manner. Roll 104 is adapted to engage the undersurface of secondary conveyor 10' and a slight elevation of this roll by the jacking assemblies J will result in a corresponding slight raising of a section of the upper flight of conveyor 10' above its normal plane. This means then, that the conveyor 10' as it moves out of the coating station 7 and away from the banks 68 of sprayheads 67, will first assume a slightly upwardly inclined path followed immediately by a downwardly inclined path such as, for example, in the area of blowoff station 8. In other words, a given can with its inside and outside surfaces covered with an uncured coating will, as it moves away from the coating station 68, move first slightly uphill and then downhill. This diverse flow path arrangement and cleavage in straight line can flow advantageously produces a separation and isolation of the various can bodies and their sidewalls one from another, while at the same time allowing substantially full contact at least of a can body's outside walls with blowoff air at station 8 thereby helping to eliminate or minimize the sticking of one can body to another as the cans move further along the processing line and toward the final curing oven at station 10.

In separating the container bodies as described, access openings for the air from the blowoff devices are provided by the open meshwork of the conveyor 10' whereby the air can blow off excess residual coating materials on the conveyor meshwork down into the collection tank or reservoir 86 for recycling through pump 83. The conveyor 10' terminates at a station 9 and adjacent dead plate 72. Station 9 contains a standard suction fan 106 and appropriate ductwork 107 for venting the coating material vapors to the atmosphere or an appropriate effluent treating apparatus.

As noted heretofore, dead plate 72 has the same structure and perforation arrangement as dead plate 65 and as in the case of plate 65 the edges of elongated openings 80 of plate 72 act as residual scrapers or wipers as the can bodies move across the dead plate 72. It is for this reason that the leading edge sections of dead plate 72 are preferably set to overlie the reservoir 86 so that the drippings of coating material K, if any, will fall into the reservoir. Again as in the case of dead plate 65, the can bodies X are advanced across dead plate 72 and onto tertiary conveyor 10'' for passage to and through the coating drying oven 70 of Zone B' under the urgings of the oncoming and succeeding can bodies and the possible vibratory action of the plate, if a vibrator 65' is connected to plate 72.

In one embodiment of the invention and in order to further aid in advancement of the can bodies across dead plate 72 as well as to segregate and isolate the can bodies from each other and thereby optimize their overall exposure to the heat of the baking oven interior 78 at station 10, it is preferred that conveyor 10'' operate at a slightly faster speed than conveyor 10' even though both conveyors are hooked up to a common drive system. This can be accomplished by using fewer driving teeth in the sprockets for roll 60 than in the sprockets for waffle roll 46 that drives conveyor 10'. By moving belt 10'' at a slightly faster rate than belt 10', belt 10'' can be made to move the cans off of the dead plate 72 at a faster rate than they are placed on the dead plate by conveyor 10'. Inasmuch as the amount of residual coating film to be cured and carried by the cans is directly related to the travel time and distance between coating material spraying and heating or curing stations, the system equipment should be so designed and operated, whereby in the case of most metal cans, regardless of whether they are aluminum or steel, the elapsed travel time of a can body X from spraying station 7 to curing station 10 should not exceed substantially about 2 minutes. In many cases 15 to 60 seconds is preferred and the residence time of the can bodies X in oven 70 should be kept to a minimum.

An open meshwork conveyor 10'' moves forward on the order of about 4 feet per minute and conveyors 10' and 10 at slightly less speeds, it should provide a minimal residence time of the can bodies within the coating baking oven 10, which in the case of aluminum cans coated with the aforesaid type coatings of the Wittaker Corporation, the Celanese Company and the Dexter Midland Corporation, need be only about 1 to 1½ minutes in order to effect a sufficient curing and hardening of the can coatings to permit further handling. Although it is to be understood that the residence time and temperature exposure for various metals, e.g., tin plate or steel vs. aluminum can vary, such times and oven temperatures will still be significantly less than those presently used in metal can coating operations. The above noted 1 to 1½ minutes oven residence time will ordinarily be sufficient to effect a drying of the coatings K for such aluminum cans to the proper hardness by means of the heated air in an oven 70 of efficient design which is circulated in the oven at a temperature of approximately from 350° F. – 475° F.

Oven 70 can have a general structure similar to the dryer of U.S. Pat. No. 3,726,020 or it can be of such a type, as indicated in the drawings, whereby air is passed downwardly into the oven proper through the hooded ductwork 125 by means of a standard blower unit 126 driven by motor 128. Air from ductwork 125 is then forced past and heated by an appropriate and thermostatically controlled gas burner unit 120 in a standard fashion and subsequently transferred through a series of ducts 132 to the underside of and below the open meshwork conveyor 10''. As the air in oven 70 heated to a temperature of, say, 475° F. passes upwardly through the open grate section formed by the conveyor 10'' the air contacts the coated can bodies X disposed on conveyor 10'' and then passes ultimately out of oven 70 through a damper controlled flue section 134 to the atmosphere, after it has been appropriately treated, so that the fumes and effluent will not contaminate the atmosphere.

In an advantageous embodiment of the invention a piston operated roll takeup device 136 may be used with conveyor 10'' because of the possible expansion and slack that may occur in portions of this conveyor due to its exposure to the elevated temperatures of oven 70. Various takeup rollers (not shown) can of course be used with conveyors 10 and 10' to take up any slack in such conveyors all in a manner well known in the art. Further, as indicated in dotted lines in FIG. 4, the inner area 78 of oven 70 can be provided with an arch roll 104' that contacts the undersurface of conveyor 10'' and which is similar in structure and function to arch roll 104 for conveyor 10'. In other words, the upper flight of conveyor 10'' can be elevated by its own jacking assembly. Thus the path of flow of the can bodies X through oven 70 can be first slightly upwardly and then slightly downwardly thereby producing further isolations or separations of individual can bodies X from each other in the area of roll 104' as the cans X move through oven 70.

In a further embodiment of the invention, and if desired, a plurality of cans 138 may be attached to shaft 38 adjacent coating action 7 to cause a slight agitation of conveyor 10' in the area of dead plate 65 as the cans advance to and through station 7. This slight agitation can help to produce an advantageous separation and isolation of the can bodies X one from another whereby the outside surfaces of each individual can body will be assured of being substantially fully exposed to the action of the spray nozzles 67 as they pass across the zone of can body coating contact and inundation.

Figure 3:
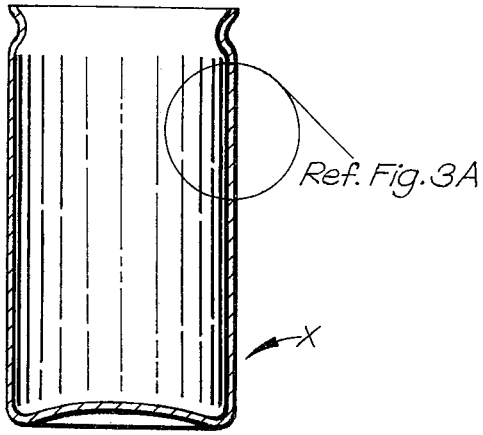
FIG. 3 is a cross-sectional view of a typical finished and coated thin walled hard or extra hard tempered, aluminum alloy, can body, which can be produced on the can manufacturing or processing line shown in FIG. 2.
Figure 3A:
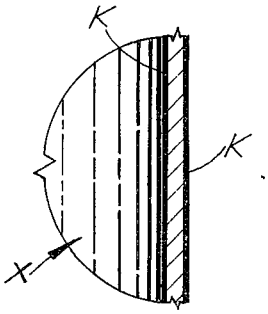
FIG. 3A is a cross-sectional view of the can of FIG. 3 when taken within the circumscribing line 3A of FIG. 3.

The instant invention has been found particularly advantageous in coating thin walled drawn and ironed cans made from a readily workable and ductile aluminum base alloy in the extra hard temper range such as the aforementioned 3004 aluminum base alloy of H-19 temper. Such a coated can is illustrated in FIGS. 3 and 3A, after the coated can has been necked and flanged. A drawn and ironed can X made from aluminum alloys in the extra hard temper range is highly desirable for a number of reasons, primarily because the strength of the cap wall resulting from its work hardened condition permits use of minimal wall thickness consistent with other requirements and a savings in overall metal content of a can. This is significant in the case of a can plant where millions of containers are produced over a prolonged period. Thus, for example, the thickness of the can wall depending on its size and use can vary from as little as 0.0048 to 0.012 inch and its bottom from 0.0145 to 0.020 inch.

At the present time, whereas it can take anywhere on the order of about 5 minutes or more depending on the particular conventional non-water based coating composition used and oven operating conditions to effect a cure in a given oven of the coatings applied to work hardened aluminum base alloy cans of the extra hard temper with resultant annealing problems, use of the instant system with water based, water soluble or at least water dispersible coatings of the type described enables the can coatings to be cured and hardened in a substantially shorter time and in as little as about 1 to 1½ minutes oven residence time. This reduction in residence time of a can coated with a water based coating as aforedescribed in the curing oven plus a significant reduction in the overall number of heating steps all constitute substantial improvements in the prevention of deleterious can annealing that could otherwise produce a decrease in the strength of such an aluminum can.

Of particular importance is the water based coating itself. Since the coating is water based during its curing and residence time in the oven, a portion of the heat applied will be absorbed and used to liberate the aqueous coating vehicle and thus allow the metal can to remain at a relatively low temperature during curing bake on. Thus, while curing of the coating takes place in a relatively rapid fashion, no heat energy will be available to cause changes in the metallurgical structure and consequently in the mechanical properties of the metal can body. The advantageous physical and mechanical properties of a work hardened or extra work hardened can body are thus for the most part preserved and not materially altered as in the past.

In keeping with the treatment procedure of minimal residence time in the curing oven, the thickness of the coating layer depending on the particular coating used should be maintained within limits and preferably should be held to between 100 milligrams to 300 milligrams of surface covered, while at the same time being of substantially uniform thickness both on the inside and outside surfaces of the can. Moreover, the relatively short oven residence time helps to avoid localized hot spots in the can coating as well as localized annealing with the result that a relatively uniformly coated holiday free surface results both inside and outside the can.

Although the instant treating system is particularly applicable to coating drawn and ironed conventional aluminum alloy cans in the extra hard temper and relatively thin walls, it is equally applicable to producing heat cured and coated drawn cans, impact extruded cans, or drawn and ironed special high iron content aluminum alloy cans of the type discussed in U.S. Pat. No. 3,691,972 issued Sept. 19, 1972 and the shaped and work hardened aluminum cans produced in accordance with the teachings of U.S. Pat. No. 3,774,559 issued Nov. 27, 1973 to Kindelvich et al.

A selected lot of standard 12 ounce drawn and ironed beverage can bodies made from 3004 aluminum alloy stock and of H-19 extra hard temper were coated and the coating cured in accordance with the instant invention. These 12 ounce can bodies made on the same draw and iron tooling all had a trimmed sidewall height of approximately 4.885 inches, an outside diameter of approximately 2.59 inches, a sidewall thickness of approximately 0.005 inch, and a concave bottom wall or end thickness of about 0.0175 inch, ± the usual manufacturing tolerances.

Thin walled containers from the said lot were coated with the water based X-1431-B coating of the Celanese Chemical Company aforementioned and the coating cured in accordance with the instant invention by passage of the coated cans having a substantially uniform coating thickness of between 200 milligrams to 250 milligrams/can through a gas heated air oven maintained at an air temperature on the order of 475° F. The average residence time of the coated cans in the oven which was not in the best operating condition at the time was about 3½ minutes. The cans moved through the oven in an upright position, while being supported on an open meshwork conveyor and with the closed ends of the cans uppermost.

Three of the cans of the lot, which are to be identified as NT cans were not coated or cured. These NT cans were subjected to certain destruction tests to determine the average can yield and tensile strengths, etc. prior to any processing with the following results. The average yield and tensile strengths of the can sidewalls for the NT cans were found to be 44,600 psi and 48,800 psi respectively. The same NT cans also had an average elongation of 2% per 2 inches of sidewall measured across the grain, a Vickers hardness of 89–93 taken at the center of a can bottom or end wall and a Vickers hardness of 96–99 taken along the can sidewall at various points from ½ to about 2½ inches in from the open end of the can.

Three other cans of the aforesaid lot of drawn and ironed aluminum alloy cans that are to be identified as T cans were fully processed or subjected both to coating and curing operations in accordance with the instant invention. After processing the T cans were tested in the same fashion as the NT cans with the following results. The T cans were found to have an average sidewall yield strength of 43,200 psi, an average sidewall tensile strength of 47,800 psi, an average elongation of 2% per 2 inches of sidewall measured across the grain, an average Vickers hardness of 89 taken at the center of the can bottom or end wall and a Vickers hardness of 91–99 taken along the can sidewall at points from ½ to about 2½ inches in from the open end of the can. In other words, the containers after being fully processed, i.e., after being coated and the coating cured in accordance with the instant invention retained substantially the same mechanical and physical properties as before processing.

Other sample NT and T cans were subjected to the standard commercial pressure tests for 12 ounce aluminum cans sometimes referred to in the trade as "end buckling" tests without failure. In this standard commercial pressure test for 12 ounch aluminum cans the open end of the can is placed over and sealed to an apertured mandrel. After sealing, compressed air is continuously admitted through the opening in the mandrel to the inside of the sealed can body at the rate of about 4 psi per second until the bottom or closed can ends becomes distorted. The minimum commercial pressure test that a 12 ounce can must meet to be acceptable for commercial use is about 90 psi. All of the NT and T cans tested were subjected to at least 96 psi without the ends thereof becoming distorted. Coating tests similar to those described with respect to the Celanese Company coating were conducted on cans provided with the Whittaker and Dexter Midland Corporation coatings with results that were substantially the same.

From the above it is to be observed that whereas in the past, a thin walled coated aluminum alloy work hardened can, and in particular a thin walled aluminum alloy work hardened can in the extra hard temper range may have required separate coating and heat curing steps for an inside coating, an outside coating and a bottom coating or possibly three separate heating and potentially deleterious annealing steps, only one heating step of minimum duration is now required to produce for many purposes an equivalently coated can.

An advantageous embodiment of the invention has been shown and described. It is obvious that various changes may be made therein without departing from the spirit and scope thereof wherein:

What is claimed is:

1. A system for treating a closed end thin walled metal container body and the like comprising a plurality of treatment stations wherein a plurality of metal container bodies are simultaneously selectively advanced in substantially the same inverted position and with their closed ends up to and through the various treatment stations, means for applying water dilutable wash and rinse solutions to and for removing selected amounts of said wash and rinse solutions from the surfaces of the container bodies as the bodies pass through certain stations of the system, means for directing a free flowing coating material at relatively high volumes and in the form of full cone overlapping flood-like sprays simultaneously against substantially all inside and outside surface portions of at least one metal container body as it is advanced through another station of said system, said coating material directing means being arranged to direct said overlapping sprays simultaneously against substantially all of the said surface portions of the container body in such fashion as to effect a hydro-fluidic balancing and stabilization of the container body in a predetermined coating material receiving position by selective fluid pressure contact of the closed end of the container body as the body passes through the coating station, separate open mesh conveyors for supporting and moving a container body in substantially the same inverted position and with its closed end up through the stations for applying the wash and rinse solutions and the coating material applying station, and means interposed between said conveyors for transferring the container body from one open mesh conveyor to the other without effecting any material change in the said inverted position of the container body.

2. The system as set forth in claim 1 wherein the central axis of each of the cone sprays is disposed at substantially a 90° angle to the normal path of flow of the container body.

3. The system as set forth in claim 1 including a coating material curing station and a separate open mesh conveyor for transferring the coated container body through the coating material curing station also in an inverted position and with its closed end up and means for transferring the said container body to said last mentioned conveyor from another conveyor while maintaining the container body in substantially the same inverted position it assumed during its passage through the coating material applying station.

4. The system as set forth in claim 1 wherein the container body transferring means comprises dead plate means.

5. A system for treating a closed end thin walled metal container body and the like comprising a plurality of treatment stations wherein metal container bodies are selectively advanced to and through the various treatment stations, means for applying water dilutable wash and rinse solutions to and for removing selected amounts of said wash and rinse solutions from the surfaces of the container bodies as the bodies pass through certain stations of the system, means for directing a free flowing coating material at relatively high volumes and in the form of full cone flood-like sprays simultaneously against substantially all inside and outside surface portions of at least one metal container body as it is advanced through another station of said system, said coating material directing means being arranged to direct sprays simultaneously against substantially all of said surface portions of the container body in such fashion as to effect a hydro-fluidic balancing and stabilization of the container body in a predetermined coating material receiving position by selective fluid pressure contact of the closed end of the container body as the body passes through the coating station and means for selectively applying and maintaining small amounts of moisture on the inside and outside surfaces of a container body prior to advancing the container body to and through the coating material applying station.

6. The system as set forth in claim 5 wherein an open mesh conveyor is used for supporting and moving container bodies in an inverted position and with their closed ends up through the coating material applying station and subsequently towards a coating material curing station.

7. A system for treating a closed end thin walled metal container body and the like comprising a plurality of treatment stations wherein metal container bodies are selectively advanced to and through the various treatment stations, means for applying water dilutable wash and rinse solutions to and for removing selected amounts of said wash and rinse solutions from the surfaces of the container bodies as the bodies pass through certain stations of the systems, means for directing a free flowing coating material at relatively high volumes and in the form of full cone flood-like sprays simultaneously against substantially all inside and outside surface portions of at least one metal container body as it is advanced through another station of said system, said coating material directing means being arranged to direct sprays simultaneously against substantially all of said surface portions of the container body in such fashion as to effect a hydro-fluidic balancing and stabilization of the container body in a predetermined coating material receiving position by selective fluid pressure contact of the closed end of the container body as the body passes through the coating station, an open mesh conveyor means for supporting and moving the container body in an inverted position and with the closed end up through the coating material applying station and subsequently towards a coating material curing station, and said open mesh conveyor means being provided with elevating means for adjustably disposing a selected portion of the upper flight thereof at a slightly upwardly inclined angle and then at a slightly downwardly inclined angle whereby at the point of mergence of the outwardly and downwardly inclined container body flow paths resulting therefrom the coated container bodies will tend to separate themselves one from another.

8. A system for treating a closed end metal can body and the like comprising a plurality of can body treatment stations, a plurality of separate open mesh type conveyors for simultaneously advancing a plurality of metal can bodies in inverted positions and their closed ends up and at selected speeds to and through the various treatment stations, means for applying water dilutable wash and rinse solutions to and for removing selected amounts of said wash and rinse solutions from the can bodies as one of the conveyors advances his can bodies through the initial stations of the system and prior to the application of a coating material to said can bodies, means for directing a free-flowing coating material at relatively high volumes and in the form of full cone flood-like sprays simultaneously against substantially all inside and outside surface portions of the can bodies as they are substantially continuously advanced through a selected station of said system by a further conveyor, said coating material spray directing means comprising nozzles arranged to direct overlapping sprays simultaneously against substantially all inside and outside surface portions of the can bodies in such fashion as to effect a hydrofluidic balancing and stabilization of the can bodies in a predetermined coating receiving position on the further conveyor by selective fluid pressure contact of the closed ends of the can bodies and the application of a substantially uniform coating to the can bodies as they pass through the coating material applying station, the said system including a coating material curing station for effecting a relatively rapid curing of the coating material applied to the can bodies as the can bodies are advanced through said last-mentioned station by another conveyor and means for operating one of the conveyors at a different rate of travel from another associated conveyor.

9. A system for treating a closed end metal can body and the like comprising a plurality of can body treatment stations, a plurality of interlinked conveyors for simultaneously advancing a plurality of metal can bodies at selected speeds to and through the various treatment stations, means for applying water dilutable wash and rinse solutions to and for removing selected amounts of said wash and rinse solutions from the can bodies as a conveyor advances the can bodies through the initial stations of the system and prior to the application of a coating material to said can bodies, means for directing a free flowing coating material at relatively high volumes and in the form of full cone flood-like sprays simultaneously against substantially all inside and outside surface portions of the can bodies as they are continuously advanced through a selected station of said system by a conveyor, said coating material spray directing means comprising nozzles arranged to direct overlapping sprays simultaneously against substantially all inside and outside surface portions of the can bodies in such fashion as to effect a hydro-fluidic balancing and stabilization of the can bodies in a predetermined coating receiving position by selective fluid pressure control of the closed ends of the can bodies and the application of a substantially uniform coating to the can bodies as they pass through the coating material applying station, said system including a coating material curing station for effecting a relatively rapid curing of the coating material applied to the can bodies and means for applying small amounts of moisture to and retaining said moisture on the inside and outside surfaces of the can bodies prior to introduction of said bodies into the coating material applying station in order to enhance the interfacial surface tension characteristics of the said surfaces of the can bodies.

10. A system for treating a closed end metal can body and the like comprising a plurality of can body treatment stations, a plurality of interlinked conveyors for simultaneously advancing a plurality of metal can bodies at selected speeds to and through the various treatment stations, means for applying water dilutable wash and rinse solutions to and for removing selected amounts of said wash and rinse solutions from the can bodies as a conveyor advances the can bodies through the initial stations of the system and prior to the application of a coating material to said can bodies, means for directing a free flowing coating material at relatively high volumes and in the form of full cone flood-like sprays simultaneously against substantially all inside and outside surface portions of the can bodies as they are continuously advanced through a selected station of said system by a conveyor, said coating material spray directing means comprising nozzles arranged to direct overlapping sprays simultaneously against substantially all inside and outside surface portions of the can bodies in such fashion as to effect a hydrofluidic balancing and stabilization of the can bodies in a predetermined coating receiving position by selective fluid pressure control of the closed ends of the can bodies and the application of a substantially uniform coating to the can bodies as they pass through the coating material applying station, said system further including a coating material curing station for effecting a relatively rapid curing of the coating material applied to the can bodies, means for applying small amounts of moisture to and retaining said moisture on the inside and outside surfaces of the can bodies prior to introduction of said bodies into the coating material applying station in order to enhance the interfacial surface tension characteristics of the said surfaces of the can bodies and separate open meshwork conveyors for advancing the can bodies in an inverted position with their closed ends up through the wash and rinse solution applying stations, the coating material applying station and the coating material curing station.

11. A system for treating a closed end metal can body and the like comprising a plurality of can body treatment stations, a plurality of interlinked conveyors for simultaneously advancing a plurality of metal can bodies at selected speeds to and through the various treatment stations, means for applying water dilutable wash and rinse solutions to and for removing selected amounts of said wash and rinse solutions from the can bodies as a conveyor advances the can bodies through the initial stations of the system and prior to the application of a coating material to said can bodies, means for directing a free flowing coating material at relatively high volumes and in the form of full cone flood-like sprays simultaneously against substantially all inside and outside surface portions of the can bodies as they are continuously advanced through a selected station of said system by a conveyor, said coating material spray directing means comprising nozzles arranged to direct overlapping sprays simultaneously against substantially all inside and outside surface portions of the can bodies in such fashion as to effect a hydrofluidic balancing and stabilization of the can bodies in a predetermined coating receiving position by selective fluid pressure contact of the closed ends of the can bodies and the application of a substantially uniform coating to the can bodies as they pass through the coating material applying station, said system further including a coating material curing station for effecting a relatively rapid curing of the coating material applied to the can bodies, means for applying small amounts of moisture to and retaining said moisture on the inside and outside surfaces of the can bodies prior to introduction of said bodies into the coating material applying station in order to enhance the interfacial surface tension characteristics of the said surfaces of the can bodies, the conveyor for advancing the can bodies through the coating material applying station comprising an open meshwork conveyor and said open meshwork conveyor being provided with means for elevating a selected section of the upper flight of said open meshwork conveyor to form a path of movement for the can bodies which is first inclined upwardly and then downwardly, the point of intersection of the upwardly and downwardly inclined paths followed by the coated can bodies acting to break the flow of can bodies whereby they will become separated from each other prior to entrance into the coating material curing station.

12. The system as set forth in claim 11 including a coating material blowoff station interposed between the can body coating station and the coated can body curing station and adjacent the point of intersection of the said upwardly and downwardly inclined paths.

13. A system for treating a closed end metal can body and the like comprising a plurality of can body treatment stations, a plurality of interlinked conveyors for simultaneously advancing a plurality of metal can bodies at selected speeds to and through the various treatment stations, means for applying water dilutable wash and rinse solutions to and for removing selected amounts of said wash and rinse solutions from the can bodies as a conveyor advances the can bodies through the initial stations of the system and prior to the application of a coating material to said can bodies, means for directing a free flowing coating material at relatively high volumes and in the form of full cone flood-like sprays simultaneously against substantially all inside and outside surface portions of the can bodies as they are continuously advanced through a selected station of said system by a conveyor, said coating material spray directing means comprising nozzles arranged to direct overlapping sprays simultaneously against substantially all inside and outside surface portions of the can bodies in such fashion as to effect a hydrofluidic balancing and stabilization of the can bodies in a predetermined coating receiving position by selective fluid pressure contact of the closed ends of the can bodies and the application of a substantially uniform coating to the can bodies as they pass through the coating material applying station, said system including a coating material curing station for effecting a relatively rapid curing of the coating material applied to the can bodies, separate open meshwork conveyors for advancing the can bodies in inserted positions and with their closed ends up through the wash and rinse solution applying stations, the coating material applying station and the coating material curing station, and at least one of the conveyors being operated at a different speed from another conveyor.

14. A system for applying a coating to a closed end metal container body and for curing the coating on said container body comprising a plurality of treatment stations, one of said stations comprising a container body spray coating station, an open meshwork conveyor for advancing the container body to and through said coating station in a substantially continuous fashion, full cone jet spray nozzle means arranged in said spray coating station for directing overlapping patterns of a free flowing coating material in high volumes and in floodlike sprays at selected angles against surface portions of the closed end metal container body as the container body passes through said spray coating station the hydro-fluidic pressure of said sprays as the sprays are applied to the container body acting simultaneously to balance stabilize and maintain the container body in the proper coating receiving position as it passes through the coating station and past the said nozzle means, means for supplying said free flowing coating material to said full cone jet spray nozzle means and means for applying small amounts of moisture to the container body prior to its passage through the coating material applying station in order to enhance the interfacial surface tension characteristics of the container body surfaces.

15. The system as set forth in claim 14 wherein the full cone jet spray nozzle means comprise individual nozzle elements located on opposed sides of the path of travel of the container body and in opposed relation to each other, and means for operating all of said nozzle elements whereby the coating material sprays from said nozzle elements simultaneously contact and uniformly adhere to substantially all interior and exterior surfaces of said container body.

16. The system as set forth in claim 14 wherein the open meshwork conveyor supports the container body in an inverted position while moving the container body through the coating station and wherein said full cone jet spray nozzle means comprise spaced parallel lines of individual nozzle elements located on opposed sides of the conveyor with the nozzle elements in one line and on one side of the conveyor being offset relative to the nozzle elements in an adjacent line on the same side of the conveyor.

17. The system as set forth in claim 14 including means for causing the container body to advance in a slightly upwardly inclined path of flow followed by a slightly downwardly inclined path of the flow substantially immediately after the container body has been coated at the coating station.

18. The system as set forth in claim 17 wherein the point of intersection of the upwardly and downwardly inclined paths followed by the coated container body is located at a coating material blowoff station interposed between the container body coating material applying station and a coated container body curing oven station.

19. A system as set forth in claim 14 including means for agitating said container body conveyor.

20. A system for applying a coating to a closed end metal container body and for curing the coating on said container body comprising a plurality of treatment stations, one of said stations comprising a container body spray coating station, means for advancing the container body to and through said coating station in a substantially continuous fashion, full cone jet spray nozzle means arranged in said spray coating station for directing overlapping patterns of a free flowing coating material in high volumes and in flood-like sprays at selected angles against surface portions of the closed end metal container body as the container body passes through said spray coating station, the hydro-fluidic pressure of said sprays as the sprays are applied to the container body acting simultaneously to balance stabilize and maintain the container body in the proper coating receiving position as it passes through the coating station and past the said nozzle means, means for supplying said free flowing coating material to said full cone jet spray nozzle means and means for applying small amounts of moisture to the container body prior to its passage to the coating material applying station in order to enhance the interfacial surface tension characteristics of the container body surfaces.

21. A system for uniformly applying a water soluble coating simultaneously to substantially all interior and exterior surface portions of a closed end metal container body and for curing the coating on said container body comprising a plurality of treatment stations, one of said stations comprising a container body spray coating station and another station comprising the coating curing station, means for advancing the container body to and through said coating station and then through the coating curing station, full cone jet spray nozzle means arranged in said spray coating station for directing overlapping patterns of a water soluble free-flowing coating material in high volumes and in flood-like sprays at selected angles simultaneously and uniformly against substantially all of the said surface portions of the closed end metal container body as the container body passes through said spray coating station, the hydro-fluidic pressure of said sprays as the sprays are applied to the container body acting simultaneously to balance stabilize and maintain the container body in the proper coating receiving position as it passes through the coating station and past the said nozzle means, means for supplying said water soluble free-flowing coating material to said full cone jet spray nozzle means, means for curing said coating on the container body when the container body arrives at the curing station, and means for applying selected amounts of a deionized water to and maintaining said water on the container body prior to its passage through the coating material applying station in order to enhance the interfacial surface tension characteristics of the container body surfaces.

22. A system as set forth in claim 21 wherein the means for advancing the container body comprises one conveyor means for advancing the container body to and through the coating station and a separate conveyor means for advancing the container body to and through the coating curing station.

23. A system as set forth in claim 22 wherein one of the conveyor means is operated at a different speed from the other conveyor means.

24. A system as set forth in claim 5 wherein said last-mentioned means comprises a means for applying deionized water to the container body.

25. A system as set forth in claim 9 wherein said last-mentioned means comprises a means for applying deionized water to the can bodies.

* * * * *

UNITED STATES PATENT OFFICE

CERTIFICATE OF CORRECTION

PATENT NO. : 3,952,698

DATED : April 27, 1976

INVENTOR(S) : Arnold D. Beyer, Charles R. Crockett and Patrick G. Mitchell

It is certified that error appears in the above-identified patent and that said Letters Patent are hereby corrected as shown below:

Column 4, line 25, "cost" should be --coat--

Column 4, line 36, "particularly" should be --particular--

Column 5, line 7, "temperated" should be --tempered--

Column 5, line 31, "bodies in a" should be --bodies pass in a--

Column 7, line 40, "rinshed" should be --rinsed--

Column 8, line 4, "thre" should be --there--

Column 8, line 62, "an" should be --a--

Column 8, line 67, "testing" should be --treating--

Column 10, line 50, "leaving controlled" should be --leaving small controlled--

Column 10, line 59, "having" should be --leaving--

Column 11, line 2, "conveyors" should be --conveyor--

Column 13, line 17, "section" should be --station--

Column 13, line 66, "10' of which" should be --10' all of which--

Column 14, line 49, "idler" should be --idle--

Column 14, line 56, "wall" should be --well--

UNITED STATES PATENT OFFICE
CERTIFICATE OF CORRECTION

PATENT NO. : 3,952,698

DATED : April 27, 1976

INVENTOR(S) : Arnold D. Beyer, Charles R. Crockett and Patrick G. Mitchell

It is certified that error appears in the above-identified patent and that said Letters Patent are hereby corrected as shown below:

Column 16, line 55, "An" should be --As--

Column 17, line 15, "120" should be --130--

Column 17, line 48, "cans" should be --cams--

Column 17, line 68, "cap" should be --can--

Column 19, line 60, "ounch" should be --ounce--

Column 22, line 9, "and" should be --with--

Column 22, line 14, "his" should be --the--

Column 22, line 63, "control" should be --contact--

Column 23, line 30, "control" should be --contact--

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*